US008116649B2

(12) United States Patent
Soures et al.

(10) Patent No.: US 8,116,649 B2
(45) Date of Patent: Feb. 14, 2012

(54) APPARATUS AND METHOD FOR ADJUSTING CLEANING STATION OPERATION IN A PRINTING APPARATUS

(75) Inventors: Michael Nicholas Soures, Webster, NY (US); Robert Steven Pozniakas, Rochester, NY (US); Roger Joseph Aurio, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/627,363

(22) Filed: Nov. 30, 2009

(65) Prior Publication Data

US 2011/0129247 A1 Jun. 2, 2011

(51) Int. Cl.
*G03G 15/00* (2006.01)
*G03G 21/00* (2006.01)

(52) U.S. Cl. ..... 399/71; 399/34; 399/354

(58) Field of Classification Search ..... 399/34, 399/71, 353, 354
See application file for complete search history.

(56) References Cited

U.S. PATENT DOCUMENTS 5,400,129 A 3/1995 Lange et al.
5,416,572 A 5/1995 Kolb et al.
5,652,951 A 7/1997 Thayer et al.
5,655,204 A 8/1997 Siegel
5,657,114 A * 8/1997 Kitajima et al. ..... 399/71
7,315,722 B2 1/2008 Kitajima et al.
7,505,704 B2 3/2009 Facci et al.
2008/0008489 A1 * 1/2008 Watanabe et al. ..... 399/71
2008/0013978 A1 * 1/2008 Facci et al. ..... 399/71
2008/0267652 A1 * 10/2008 Nishikawa ..... 399/71

* cited by examiner

*Primary Examiner* — David Gray
*Assistant Examiner* — Joseph Wong
(74) *Attorney, Agent, or Firm* — Ronald E. Prass, Jr.; Prass LLP

(57) ABSTRACT

An apparatus (100) and method (200) that adjusts cleaning station operation in a printing apparatus is disclosed. The apparatus can include a charge receptor (110) movable in a process direction P, where the charge receptor can have a main surface (111). The apparatus can include a charger (140) configured to generate a charge on the charge receptor and an image generator (118) configured to generate an image on the charge receptor. The apparatus can include a cleaning station (124) coupled to the charge receptor. The cleaning station can include a cleaning brush (125) coupled to the main surface of the charge receptor. The cleaning station can be configured to clean the main surface of the charge receptor. The apparatus can include a controller (150) coupled to the cleaning station. The controller can be configured to determine a type of image generated on the charge receptor and can be configured to adjust cleaning parameters of operation of the cleaning station based on the type of image generated on the charge receptor.

20 Claims, 4 Drawing Sheets

APPARATUS AND METHOD FOR ADJUSTING CLEANING STATION OPERATION IN A PRINTING APPARATUS

BACKGROUND

Disclosed herein is an apparatus and method that adjusts cleaning station operation in a printing apparatus.

Presently, image output devices, such as printers, multifunction media devices, xerographic machines, ink jet printers, and other devices produce images on media sheets, such as paper, substrates, transparencies, plastic, cardboard, or other media sheets. To produce an image, a photoreceptor transfers marking material, such as toner, ink jet ink, or other marking material, to a media sheet to create a latent image on the media sheet. A fuser assembly then affixes or fuses the latent image to the media sheet by applying heat and/or pressure to the media sheet. After the image is affixed to the media sheet, a cleaning station uses a rotating cleaning brush to clean residual marking material and other debris off the photoreceptor.

Unfortunately, photoreceptor cleaning is abrasive and erodes the photoreceptor surface and performance over time. Current cleaning implementations are designed for stress cases involving high density solids and lines of significant length in the photoreceptor process direction. Thus, current cleaning implementations involve higher biases and faster cleaning brush revolutions per minute (RPM's) which can adversely impact both the system reliability from the higher bias and the print quality from faster RPM's. Current cleaning implementations do not adjust cleaning station operation based on the type of image on the photoreceptor.

Thus, there is a need for an apparatus and method that adjusts cleaning station operation in a printing apparatus.

SUMMARY

An apparatus and method that adjusts cleaning station operation in a printing apparatus is disclosed. The apparatus can include a charge receptor movable in a process direction, where the charge receptor can have a main surface. The apparatus can include a charger configured to generate a charge on the charge receptor and an image generator configured to generate an image on the charge receptor. The apparatus can include a cleaning station coupled to the charge receptor. The cleaning station can include a cleaning brush coupled to the main surface of the charge receptor. The cleaning station can be configured to clean the main surface of the charge receptor. The apparatus can include a controller coupled to the cleaning station. The controller can be configured to determine a type of image generated on the charge receptor and can be configured to adjust cleaning parameters of operation of the cleaning station based on the type of image generated on the charge receptor.

BRIEF DESCRIPTION OF THE DRAWINGS

In order to describe the manner in which advantages and features of the disclosure can be obtained, a more particular description of the disclosure briefly described above will be rendered by reference to specific embodiments thereof, which are illustrated in the appended drawings. Understanding that these drawings depict only typical embodiments of the disclosure and are not therefore to be considered to be limiting of its scope, the disclosure will be described and explained with additional specificity and detail through the use of the accompanying drawings in which.

DETAILED DESCRIPTION

Figure 1:
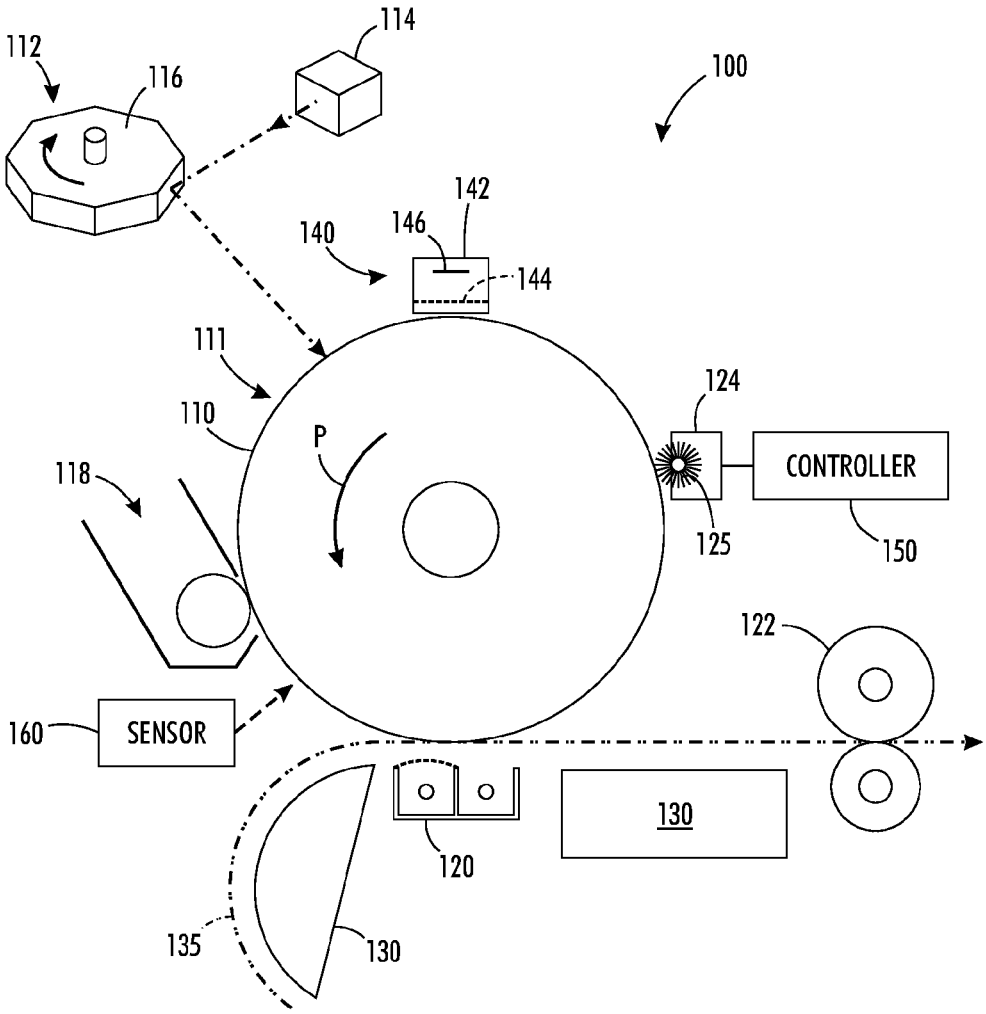
FIG. 1 is an exemplary illustration of an apparatus according to a possible embodiment.

The embodiments include an apparatus for adjusting cleaning station operation in a printing apparatus. The apparatus can include a charge receptor movable in a process direction, where the charge receptor can have a main surface. The apparatus can include a charger configured to generate a charge on the charge receptor and an image generator configured to generate an image on the charge receptor. The apparatus can include a cleaning station coupled to the charge receptor. The cleaning station can include a cleaning brush coupled to the main surface of the charge receptor. The cleaning station can be configured to clean the main surface of the charge receptor. The apparatus can include a controller coupled to the cleaning station. The controller can be configured to determine a type of image generated on the charge receptor and can be configured to adjust cleaning parameters of operation of the cleaning station based on the type of image generated on the charge receptor.

The embodiments further include a method of for adjusting cleaning station operation in a printing apparatus having a charge receptor movable in a process direction, the charge receptor having a main surface, the apparatus also having a charger, an image generator, and a cleaning station coupled to the charge receptor, the cleaning station including a cleaning brush coupled to the main surface of the charge receptor, the apparatus also having a controller coupled to the cleaning station. The method can include generating a charge, using the charger, on the charge receptor. The method can include generating an image, using the image generator, on the charge receptor. The method can include cleaning, using the cleaning brush, the main surface of the charge receptor. The method can include determining, using the controller, a type of image generated on the charge receptor. The method can include adjusting, using the controller, cleaning parameters of operation of the cleaning station based on the type of image generated on the charge receptor.

The embodiments further include an apparatus for adjusting cleaning station operation in a printing apparatus. The apparatus can include a charge receptor movable in a process direction, where the charge receptor can have a main surface. The apparatus can include a charger configured to generate a charge on the charge receptor. The apparatus can include an image generator configured to generate an image on the charge receptor. The apparatus can include a cleaning station coupled to the charge receptor. The cleaning station can include a cleaning brush coupled to the main surface of the charge receptor. The cleaning station can be configured to clean the main surface of the charge receptor. The apparatus can include a sensor configured to sense an image generated on the charge receptor. The apparatus can include a controller coupled to the cleaning station. The controller can be configured to determine a type of image generated on the charge receptor based on the sensed image and can be configured to adjust cleaning parameters of operation of the cleaning brush based on the type of image generated on the charge receptor. The apparatus can include a transfer unit coupled to the charge receptor. The transfer unit can be configured to transfer the image to media.

FIG. 1 is an exemplary illustration of an apparatus 100, such as an electrostatographic printing apparatus, a xerographic printing apparatus, an ink jet printing apparatus, or any other apparatus that generates an image on media. The apparatus 100 may also be part of a printer, a multifunction media device, a xerographic machine, a laser printer, an ink jet printer, or any other device that generates an image on media. The apparatus 100 can include a media transport 130 that can transport media 135, such as paper, plastic, stickers, or other media. The apparatus 100 can include a charge receptor 110 movable in a process direction P. The charge receptor 110 can have a main surface 111. The charge receptor 110 can be a photoreceptor. The charge receptor 110 can also be part of a marking system including a photoreceptor, where the photoreceptor can have a photoreceptor charge transport surface 111. For example, a photoreceptor can be a belt or drum and can include a photoreceptor charge transport surface for forming electrostatic images thereon. A photoreceptor can rotate in a process direction P and can generate an image on the media 135.

The apparatus 100 can include a charger 140 configured to generate a charge on the charge receptor 110. The charger 140 can be a scorotron, a charge roll, or any other electric field generation device, that can apply a voltage to a photoconductor 110. For example, a scorotron 140 can include a scorotron shield 142, a scorotron charging grid 144, and a scorotron wire or pin array 146 located on an opposite side of the scorotron charging grid 144 from the photoconductor 110. The scorotron pin array 146 can be configured to generate an electric field. The scorotron charging grid 144 and the scorotron pin array 146 can be configured to generate a surface potential on the photoconductor 110. In a more detailed operation, the charger 140 can charge the charge receptor 110 surface by imparting an electrostatic charge on the surface of the charge receptor 110 as the charge receptor 110 rotates in the process direction P.

The apparatus 100 can include an image generator 112 configured to generate an image on the charge receptor 110. The image generator 112 can be a raster output scanner, such as a laser source, a Light Emitting Diode (LED) bar, or other relevant device, that can discharge selected portions of the charge receptor 110 in a configuration corresponding to a desired image to be printed. For example, a raster output scanner can discharge a latent image to a more positive voltage. As a further example, the charger 112 can be a raster output scanner that can include a laser source 114 and a rotatable mirror 116, which can act together to discharge certain areas of the surface of the charge receptor 110 according to a desired image to be printed. Other elements can be used instead of a laser source 114 to selectively discharge the charge-retentive surface 111, such as an LED bar, a light-lens system, or other elements that can discharge a charge-retentive surface. The laser source 114 can be modulated in accordance with digital image data fed into it, and the rotatable mirror 116 can cause the modulated beam from the laser source 114 to move in a fast-scan direction perpendicular to the process direction P of the charge receptor 110.

The apparatus 100 can include a fuser 122 that can transfer the image on the charge receptor to the media 135. For example, the fuser 122 can cause marking material, such as toner or ink, to melt or fuse into the media 135 to create a permanent image on the media 135. The apparatus 100 can include a cleaning station 124 coupled to the charge receptor 110. The cleaning station 124 can be configured to clean the main surface 111 of the charge receptor 110. The cleaning station 124 can include a cleaning brush 125 coupled to the main surface 111 of the charge receptor 110. For example, the cleaning device 124 can clean the charge receptor 110 using an electric field generated between the fibers of the brush 125 and residual toner on the charge receptor surface 111 after an image is transferred to the media 135.

The apparatus 100 can include a controller 150 coupled to the cleaning station 124. The controller 150 can also be coupled to the charge device 140, the charge receptor 110, and other elements of the apparatus 100 and can control operations of the apparatus 100. The controller 150 can be configured to determine a type of image generated on the charge receptor 110 and can be configured to adjust cleaning parameters of operation of the cleaning station 124 based on the type of image generated on the charge receptor 110. For example, the controller 150 can preview the image generated on the charge receptor 110 and can determine a type of image generated on the charge receptor 110 based on the previewed image. As a further example, the type of image can be based on density of marking material, such as mass per area of the marking material in the process direction P, can be based on a length of dense lines in the process direction P, can be a text image, can be a picture image, can be a combination of text and graphics, can be a lubrication patch, or can be any other type of image. The type of image can also be based on the image structure of the image, such as the composition of lines on the image, the repetition vs. randomness of lines on the image, or other toner images. For example, half tones and text can be less dense than solids and recurring lines. To elaborate, text can be more random than a recurring line and less prone to create a ghost image. Such information about the type of image can be used to adjust cleaning parameters of operation of the cleaning station 124.

According to one embodiment, the controller 150 can be configured to determine type of image generated on the charge receptor 110 by determining a density of marking material of the image and can be configured to adjust cleaning parameters of operation of the cleaning station 124 based on the density of marking material of the image. As another example, the controller 150 can be configured to determine type of image generated on the charge receptor 110 by determining an image structure of the image and can be configured to adjust cleaning parameters of operation of the cleaning station 124 based on the image structure of the image.

The controller 150 can adjust cleaning parameters of operation of the cleaning station 124 by adjusting a revolution speed of the cleaning brush 125 based on the type of image. The controller can adjust the revolution speed of the cleaning brush 125 by lowering the cleaning brush revolution speed for a lower density of marking material of the image and by raising the cleaning brush revolution speed for a higher density of marking material of the image. For example, the controller 150 can adjust the revolution speed of the cleaning brush 125 by raising the revolution speed for repetitive stresses and by lowering the revolution speed for less repetitive stresses.

The controller 150 can be configured to determine stress on the cleaning brush 125 based on the type of image generated on the charge receptor 110 and can be configured to adjust cleaning parameters of operation of the cleaning station 124 based on the stress on the cleaning brush 125. For example, stress on the cleaning brush 125 can be based on high density of marking material, such as toner, ink, or other marking material. Also, stress on the cleaning brush 125 can be related to stress on the charge receptor 110 from the cleaning brush 125. The controller 150 can be configured to adjust cleaning parameters of operation of the cleaning station 124 by lowering a bias of the cleaning brush 125 for less stressful conditions and by raising the bias of the cleaning brush 125 for more stressful conditions based on the stress on the cleaning brush 125. For example, failure modes can occur from higher bias of the cleaning brush 125, such as from arcing in the device. Less energy, such as based on the cleaning brush voltage, can provide higher reliability of a printing apparatus image generation subsystem.

As a further example, the controller 150 can process a digital image to operate the image generator 112 to generate the image on the charge receptor 110. The controller 150 can preview the type of image generated on the charge receptor 110 based on information about the processed image. For example, the controller 150 can include a digital front end that can receive image data for printing an image. The controller 150 can analyze the image data to determine the density of marking material that can be used to generate the image on the charge receptor 110. The controller 150 can adjust parameters of operation of the cleaning station 124 based on the density of marking material and/or based on other information from the image data.

The apparatus 100 can include a sensor 160 configured to sense an image generated on the charge receptor 110. The sensor 160 can be coupled to the controller 150. The controller 150 can determine a type of image generated on the charge receptor 110 based on the sensed image. The sensor 160 can be a full width array sensor, a toner concentration (TC) sensor, a tribo sensor, or any other sensor useful to sense an image generated on the charge receptor 110. For example, an electrostatic sensor can be used to detect the toner concentration and/or a tribo sensor can detect a charge on the charge receptor 110. As a further example, existing sensors in a printing apparatus can be repositioned to determine the image structure and/or density. As an alternate example, one or more sensors can be added to detect a type of image on the charge receptor. Existing or additional sensors can not only incorporate existing functions of process controls, they can also use existing structures and/or can be modular for an enhanced process control strategy and efficient cleaning mechanism.

The apparatus 100 can include a development unit 118 coupled to the charge receptor 110. The development unit 118 can be configured to develop the image on the charge receptor 110. For example, after certain areas of the charge receptor 110 are discharged by the laser source 114, a developer unit 118 can develop an exposed latent image by applying a voltage bias using the developer unit 118. The developer unit 118 can cause a supply of marking material, such as dry toner or ink, to contact or otherwise approach the exposed latent image on the surface of the charge receptor 110.

The apparatus 100 can include a transfer unit 120 coupled to the charge receptor 110. The transfer unit 120 can be configured to transfer the developed image to the media 135. For example, the transfer unit 120 can cause the toner adhering to the charge receptor 110 to be electrically transferred to the media 135.

The sensor 160 can be located between the development unit 118 and the transfer unit 120. For example, the sensor 160 can be located after the development unit 118 and before the transfer unit 120 based on the process direction P of the charge receptor 110. The sensor 160 can detect the full image on the charge receptor 110 before it is transferred to a media sheet and then the controller 150 can determine exactly what is being transferred to the media sheet from the charge receptor 110.

The controller 150 also can be configured to determine the type of image is a lubrication patch and can be configured to adjust cleaning parameters of operation of the cleaning station 124 to stop cleaning based on the type of image being a lubrication patch.

According to a related embodiment, the apparatus 100 can include a charge receptor 110 movable in a process direction P. The charge receptor 110 can have a main surface 111. The apparatus 100 can include a charger 140 configured to generate a charge on the charge receptor 110. The apparatus 100 can include an image generator 112 configured to generate an image on the charge receptor 110. The apparatus 100 can include a cleaning station 124 coupled to the charge receptor 110. The cleaning station 124 can be configured to clean the main surface 111 of the charge receptor 110. The cleaning station 124 can include a cleaning brush 125 coupled to the main surface 111 of the charge receptor 110. The apparatus 100 can include a sensor 160 configured to sense an image generated on the charge receptor 110. The apparatus 100 can include a controller 150 coupled to the cleaning station 124. The controller 150 can be configured to determine a type of image generated on the charge receptor 110 based on the sensed image. The controller 150 can also be configured to adjust cleaning parameters of operation of the cleaning brush 125 based on the type of image generated on the charge receptor 110. The apparatus 100 can include a transfer unit 120 coupled to the charge receptor 110. The transfer unit 120 can be configured to transfer the image to media 135.

The apparatus 100 can include a development unit 118 coupled to the charge receptor 110. The development unit 118 can be configured to develop the image on the charge receptor 110. The transfer unit 120 can be configured to transfer the developed image to media 135. The sensor 160 can be located between the development unit 120 and the transfer unit 118.

Figure 2:
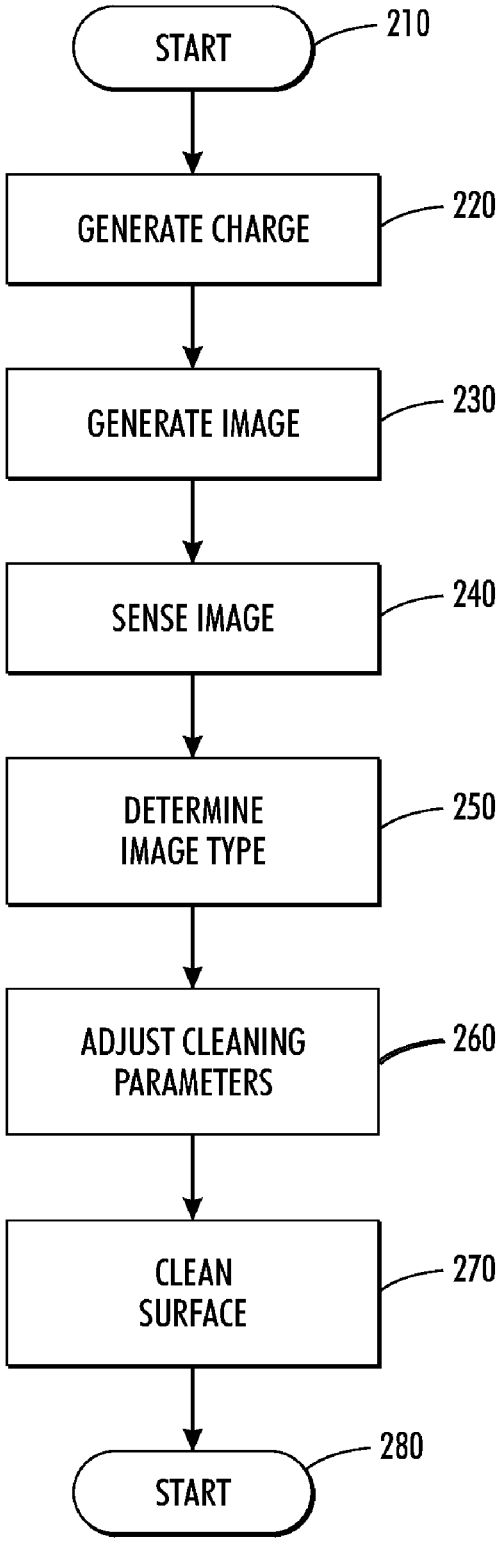
FIG. 2 is an exemplary flowchart of a method according to a possible embodiment.

FIG. 2 illustrates an exemplary flowchart 200 of a method in an electrostatographic printing apparatus, such as the apparatus 100. The apparatus can include a charge receptor movable in a process direction. The charge receptor can have a main surface. The apparatus can include a charger, an image generator, and a cleaning station coupled to the charge receptor. The cleaning station can include a cleaning brush coupled to the main surface of the charge receptor. The apparatus can include a sensor. The apparatus can include a development unit coupled to the charge receptor, where the development unit can be configured to develop an image on the charge receptor. The apparatus can include a transfer unit coupled to the charge receptor, where the transfer unit can be configured to transfer the developed image to media. The sensor can be located between the development unit and the transfer unit. The apparatus can include a controller coupled to the cleaning station. The method starts at 210. At 220, the charger can generate a charge on the charge receptor. At 230, the image generator can generate an image on the charge receptor. At 240, the sensor can sense an image generated on the charge receptor. At 250, the controller can determine a type of image generated on the charge receptor. For example, the controller can preview the image generated on the charge receptor and can determine the type of image generated on the charge receptor based on the previewed image. As a further example, the controller can determine a type of image generated on the charge receptor by determining a density of marking material of the image. The controller can also determine the type of image generated on the charge receptor by determining an image structure of the image. When determining the type of image, the controller can determine stress on the cleaning brush based on the type of image generated on the charge receptor. The controller can also determine a type of image generated on the charge receptor based on the sensed image.

At 260, the controller can adjust cleaning parameters of operation of the cleaning station based on the type of image generated on the charge receptor. For example, the controller can adjust cleaning parameters of operation of the cleaning station based on the density of marking material of the image. The controller can also adjust cleaning parameters of operation of the cleaning station based on the image structure of the image. The controller can also adjust cleaning parameters of operation of the cleaning station by adjusting a revolution speed of the cleaning brush based on the type of image. The controller can adjust a revolution speed of the cleaning brush by lowering the cleaning brush revolution speed for lower density of marking material of the image and raising the cleaning brush revolution speed for higher density of marking material of the image. The controller can also adjust cleaning parameters of operation of the cleaning station based on the stress on the cleaning brush. The controller can also adjust cleaning parameters of operation of the cleaning station by lowering a bias of the cleaning brush for less stressful conditions and by raising the bias of the cleaning brush for more stressful conditions based on the stress on the cleaning brush. At 270, the cleaning brush can clean the main surface of the charge receptor. At 280, the method can end.

Figure 3:
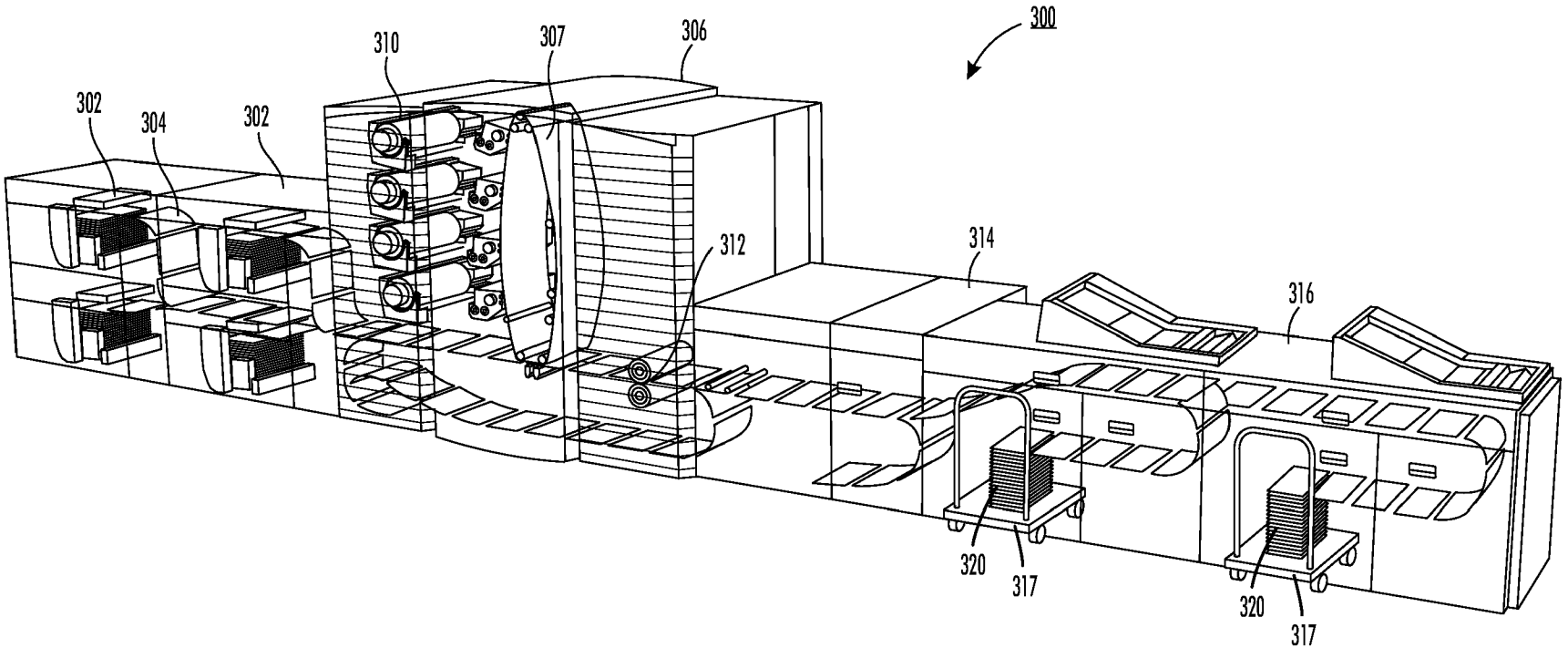
FIG. 3 is an exemplary illustration of a printing apparatus according to a possible embodiment.

FIG. 3 illustrates an exemplary printing apparatus 300. As used herein, the term "printing apparatus" encompasses any apparatus, such as a digital copier, bookmaking machine, multifunction machine, and other printing devices that perform a print outputting function for any purpose. The printing apparatus 300 can be used to produce prints on various media, such as coated, uncoated, previously marked, or plain paper sheets. The media can have various sizes and weights. In some embodiments, the printing apparatus 300 can have a modular construction. As shown, the printing apparatus 300 can include at least one media feeder module 302, a printer module 306 adjacent the media feeder module 302, an inverter module 314 adjacent the printer module 306, and at least one stacker module 316 adjacent the inverter module 314.

In the printing apparatus 300, the media feeder module 302 can be adapted to feed media 304 having various sizes, widths, lengths, and weights to the printer module 306. The printer module 306 can include the apparatus 100. In the printer module 306, toner is transferred from an arrangement of developer stations 310 to a charged photoreceptor belt 307 to form toner images on the photoreceptor belt 307. The toner images are transferred to the media 304 fed through a paper path. The media 304 are advanced through a fuser 312 adapted to fuse the toner images on the media 304. The inverter module 314 manipulates the media 304 exiting the printer module 306 by either passing the media 304 through to the stacker module 316, or by inverting and returning the media 304 to the printer module 306. In the stacker module 316, printed media are loaded onto stacker carts 317 to form stacks 320.

Figure 4:
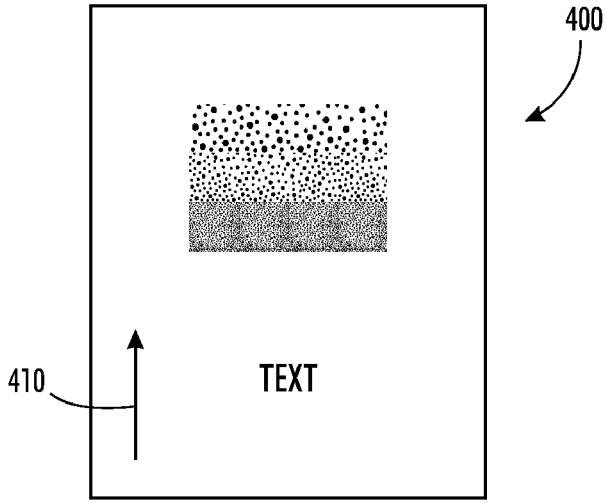
FIG. 4 is an exemplary illustration of an image that can be printed on a media sheet as the media sheet moves in the process direction according to a possible embodiment.

FIG. 4 is an exemplary illustration of an image 400 that can be printed on a media sheet as the media sheet moves in the process direction 410 according to a possible embodiment. The image 400 can include halftone images and text that can place less stress on a cleaning brush. Thus, the bias and revolution speed of a cleaning brush can be reduced when cleaning a charge receptor that produced the image 400.

Figure 5:
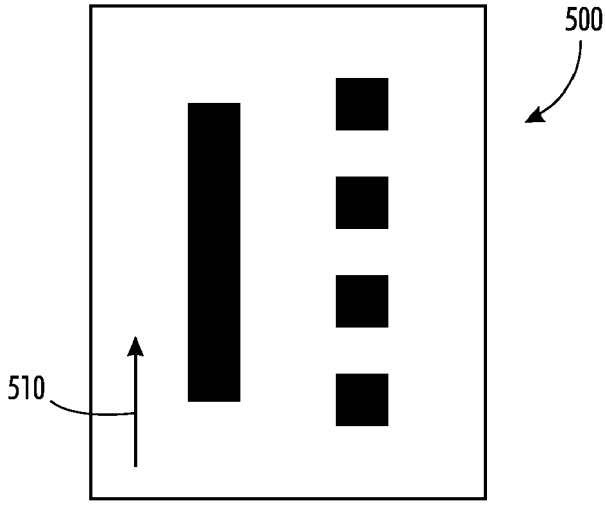
FIG. 5 is an exemplary illustration of an image that can be printed on a media sheet as the media sheet moves in the process direction according to a possible embodiment.

FIG. 5 is an exemplary illustration of an image 500 that can be printed on a media sheet as the media sheet moves in the process direction 510 according to a possible embodiment. The image 500 can include solids, lines in the process direction 510, and repetitive solids or repetitive lines that can place more stress on a cleaning brush. Thus, the bias and revolution speed of a cleaning brush can be increased when cleaning a charge receptor that produced the image 500.

Embodiments can provide for longer photoreceptor and cleaner brush life using optimal cleaner brush revolutions per minute (RPM) and bias as determined by a sensor, such as a full width inline sensor. A full width array sensor or a full width TC/tribo sensor can be used before transfer. A controller can determine the type of image and adjust cleaning parameters appropriately so that more aggressive cleaning can be implemented in the presence of high density lines and solids. Normal images, such as non-stressful half tones and text, may not require the same level of cleaning and corresponding lower cleaning brush RPM's and a lower bias can result in increased photoreceptor performance and improved system reliability. A sensor, such as a full width array sensor, can be located after development but before transfer so that a controller can determine the type of image and initiate stressed level cleaning parameters in the presence of stress images. The image stress factors for cleaning can include high density (mass/area) in the process direction. Depending upon the speed of the power supplies and the cleaner motor implemented, the bias and RPM can be switched fast enough for optimal control patch cleaning for improved productivity and/or for no cleaning for photoreceptor lubrication patches. The resulting improvement on both photoreceptor life and machine productivity can yield run cost benefits for a printing apparatus.

According to some embodiments, a sensor, such as a full width array sensor, can be implemented for real time feedback. Image density can be calculated in real time based on a TC/Tribo sensor and a development field of the printing apparatus. Also, cleaning parameters can be controlled based on image stress level. For example, when stress lines and solids are not present, a cleaner brush can run at substantially lower RPM and bias levels, which can increase both the cleaner brush and photoreceptor life. Depending upon types of images being run, the cleaner brush and photoreceptor life may be extended for up to 20% or more.

Embodiments may be implemented on a programmed processor. However, the embodiments may also be implemented on a general purpose or special purpose computer, a programmed microprocessor or microcontroller and peripheral integrated circuit elements, an integrated circuit, a hardware electronic or logic circuit such as a discrete element circuit, a programmable logic device, or the like. In general, any device on which resides a finite state machine capable of implementing the embodiments may be used to implement the processor functions of this disclosure.

While this disclosure has been described with specific embodiments thereof, it is evident that many alternatives, modifications, and variations will be apparent to those skilled in the art. For example, various components of the embodiments may be interchanged, added, or substituted in the other embodiments. Also, all of the elements of each figure are not necessary for operation of the embodiments. For example, one of ordinary skill in the art of the embodiments would be enabled to make and use the teachings of the disclosure by simply employing the elements of the independent claims. Accordingly, the embodiments of the disclosure as set forth herein are intended to be illustrative, not limiting. Various changes may be made without departing from the spirit and scope of the disclosure.

In this document, relational terms such as "first," "second," and the like may be used solely to distinguish one entity or action from another entity or action without necessarily requiring or implying any actual such relationship or order between such entities or actions. Also, relational terms, such as "top," "bottom," "front," "back," "horizontal," "vertical," and the like may be used solely to distinguish a spatial orientation of elements relative to each other and without necessarily implying a spatial orientation relative to any other physical coordinate system. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a," "an," or the like does not, without more constraints, preclude the existence of additional identical elements in the process, method, article, or apparatus that comprises the element. Also, the term "another" is defined as at least a second or more. The terms "including," "having," and the like, as used herein, are defined as "comprising."

We claim:

1. A printing apparatus, comprising:

a charge receptor movable in a process direction, the charge receptor having a main surface;

a charger configured to generate a charge on the charge receptor;

an image generator configured to generate an image on the charge receptor;

a cleaning station coupled to the charge receptor, the cleaning station configured to clean the main surface of the charge receptor, the cleaning station including a cleaning brush coupled to the main surface of the charge receptor; and a controller coupled to the cleaning station, the controller configured to preview the image generated on the charge receptor, configured to determine a type of image generated on the charge receptor based on the previewed image, and configured to adjust cleaning parameters of operation of the cleaning station based on the type of image generated on the charge receptor, wherein the controller is configured to adjust cleaning parameters of operation of the cleaning station by lowering a bias of the cleaning brush and by raising the bias of the cleaning brush based on the type of image generated on the charge receptor.

2. The apparatus according to claim 1, wherein the controller is configured to determine type of image generated on the charge receptor by determining a density of marking material of the image and is configured to adjust cleaning parameters of operation of the cleaning station based on the density of marking material of the image.

3. The apparatus according to claim 1, wherein the controller is configured to determine type of image generated on the charge receptor by determining an image structure of the image and is configured to adjust cleaning parameters of operation of the cleaning station based on the image structure of the image.

4. The apparatus according to claim 1, wherein the controller is configured to adjust cleaning parameters of operation of the cleaning station by adjusting a revolution speed of the cleaning brush based on the type of image.

5. The apparatus according to claim 4, wherein the controller is configured to adjust the revolution speed of the cleaning brush by lowering the cleaning brush revolution speed for a lower density of marking material of the image and by raising the cleaning brush revolution speed for a higher density of marking material of the image.

6. The apparatus according to claim 1, wherein the controller is configured to determine stress on the cleaning brush based on the type of image generated on the charge receptor and is configured to adjust cleaning parameters of operation of the cleaning station based on the stress on the cleaning brush.

7. The apparatus according to claim 6, wherein the controller is configured to adjust cleaning parameters of operation of the cleaning station by lowering a bias of the cleaning brush for less stressful conditions and by raising the bias of the cleaning brush for more stressful conditions based on the stress on the cleaning brush.

8. The apparatus according to claim 1, further comprising a sensor configured to sense an image generated on the charge receptor, wherein the controller is configured to determine a type of image generated on the charge receptor based on the sensed image.

9. The apparatus according to claim 8, further comprising:

a development unit coupled to the charge receptor, the development unit configured to develop the image on the charge receptor; and a transfer unit coupled to the charge receptor, the transfer unit configured to transfer the developed image to media, wherein the sensor senses the image on the charge receptor between the development unit and the transfer unit.

10. The apparatus according to claim 1, wherein the controller is configured to determine the type of image is a lubrication patch and is configured to adjust cleaning parameters of operation of the cleaning station to stop cleaning based on the type of image being a lubrication patch.

11. The apparatus according to claim 1, wherein the controller is configured to process a digital image to operate the image generator to generate the image on the charge receptor, and wherein the controller is configured to preview the type of image generated on the charge receptor based on information about the processed image.

12. A method in a printing apparatus including a charge receptor movable in a process direction, the charge receptor having a main surface, the apparatus also including a charger, an image generator, and a cleaning station coupled to the charge receptor, the cleaning station including a cleaning brush coupled to the main surface of the charge receptor, the apparatus also including a controller coupled to the cleaning station, the method comprising:

generating a charge, using the charger, on the charge receptor;

generating an image, using the image generator, on the charge receptor;

previewing the image generated on the charge receptor;

determining, using the controller, a type of image generated on the charge receptor based on the previewed image;

adjusting, using the controller, cleaning parameters of operation of the cleaning station based on the type of image generated on the charge receptor; and cleaning, using the cleaning brush, the main surface of the charge receptor, wherein adjusting cleaning parameters of operation of the cleaning station includes lowering a bias of the cleaning brush and raising the bias of the cleaning brush based on the type of image generated on the charge receptor.

13. The method according to claim 12, wherein determining comprises determining a type of image generated on the charge receptor by determining a density of marking material of the image, and wherein adjusting comprises adjusting cleaning parameters of operation of the cleaning station based on the density of marking material of the image.

14. The method according to claim 12, wherein adjusting comprises adjusting cleaning parameters of operation of the cleaning station by adjusting a revolution speed of the cleaning brush based on the type of image.

15. The method according to claim 14, wherein adjusting a revolution speed of the cleaning brush comprises adjusting the revolution speed of the cleaning brush by lowering the cleaning brush revolution speed for lower density of marking material of the image and raising the cleaning brush revolution speed for higher density of marking material of the image.

16. The method according to claim 12, further comprising determining stress on the cleaning brush based on the type of image generated on the charge receptor, wherein adjusting comprises adjusting cleaning parameters of operation of the cleaning station based on the stress on the cleaning brush.

17. The method according to claim 12, wherein the apparatus includes a sensor, wherein the method further comprises sensing, using the sensor, an image generated on the charge receptor, and wherein determining comprises determining a type of image generated on the charge receptor based on the sensed image.

18. An electrostatographic printing apparatus, comprising:

a charge receptor movable in a process direction, the charge receptor having a main surface;

a charger configured to generate a charge on the charge receptor;

an image generator configured to generate an image on the charge receptor;

a cleaning station coupled to the charge receptor, the cleaning station configured to clean the main surface of the charge receptor, the cleaning station including a cleaning brush coupled to the main surface of the charge receptor;

a sensor configured to sense an image generated on the charge receptor;

a controller coupled to the cleaning station, the controller configured to determine a type of image generated on the charge receptor based on the sensed image, and configured to adjust cleaning parameters of operation of the cleaning brush based on the type of image generated on the charge receptor; and a transfer unit coupled to the charge receptor, the transfer unit configured to transfer the image to media.

19. The apparatus according to claim 18, further comprising:

a development unit coupled to the charge receptor, the development unit configured to develop the image on the charge receptor;

wherein the transfer unit is configured to transfer the developed image to media, and wherein the sensor senses the image on the charge receptor between the development unit and the transfer unit.

20. The apparatus according to claim 18, wherein the controller is configured to adjust cleaning parameters of operation of the cleaning brush by lowering a bias of the cleaning brush and by raising the bias of the cleaning brush based on the type of image generated on the charge receptor.

* * * * *